US005225873A

United States Patent [19]

Lux et al.

[11] Patent Number: 5,225,873

[45] Date of Patent: Jul. 6, 1993

[54] PHOTORECEPTOR END OF LIFE PREDICTOR

[75] Inventors: Richard A. Lux, Webster; Debbie S. Wickham, Macedon, both of N.Y.

[73] Assignee: Xerox Corporation, Stamford, Conn.

[21] Appl. No.: 937,099

[22] Filed: Aug. 31, 1992

[51] Int. Cl.[5] ..... G03G 21/00

[52] U.S. Cl. ..... 355/208; 355/200; 355/203; 355/204

[58] Field of Search ..... 355/200, 202, 203-209, 355/211, 212; 364/551.01, 525; 371/16.4, 29.1

[56] References Cited

U.S. PATENT DOCUMENTS

| | | | |
|---|---|---|---|
| 3,898,001 | 8/1975 | Hardenbrook et al. | 355/200 |
| 4,703,325 | 10/1987 | Chamberlin et al. | 364/551.01 X |
| 5,016,050 | 5/1991 | Roehrs et al. | 355/208 |
| 5,027,268 | 6/1991 | Sakurai et al. | 364/551.01 X |
| 5,057,866 | 10/1991 | Hill, Jr. et al. | 355/200 |
| 5,127,012 | 6/1992 | Hiliger | 371/16.4 X |

FOREIGN PATENT DOCUMENTS

| | | | |
|---|---|---|---|
| 0158067 | 12/1982 | German Democratic Rep. | 364/551.01 |

*Primary Examiner*—A. T. Grimley
*Assistant Examiner*—Matthew S. Smith
*Attorney, Agent, or Firm*—H. Fleischer; J. E. Beck; R. Zibelli

[57] ABSTRACT

An improved method and apparatus for predicting the end of life of a photoreceptor, first records sampled data, then processes the data in order to interpolate the photoreceptor's end of life. Increased prediction accuracy is realized since both global photoreceptor information concerning a population of photoreceptors as well as information directed to a specific photoreceptor operating under particular environmental conditions are taken into account. This information is used not only to predict photoreceptor end of life but to make adjustments in the printing machine to correct xerographic degradations. In one embodiment, the information is used to direct an embedded end of life predictions system for notifying service at a remote site of photoreceptor problems in the printing machine in such a manner that it is transparent to a user of the printing machine. An alternative embodiment of the invention provides real time feedback to a service requests for the condition of a photoreceptor within a printing machine.

21 Claims, 5 Drawing Sheets

PHOTORECEPTOR END OF LIFE PREDICTOR

BACKGROUND OF THE INVENTION

The present invention relates generally to an electrophotographic printing machine, and more particularly concerns a method and apparatus for predicting the life of a photoconductive imaging member used in the printing machine.

Generally, the process of electrophotographic printing includes charging a photoconductive member to a substantially uniform potential to sensitize the surface thereof. The charged portion of the photoconductive surface is exposed to a pattern of activating electromagnetic radiation such as light, which selectively dissipates the charge in the illuminated areas of the photoconductive member while leaving behind an electrostatic latent image in the non-illuminated area. This electrostatic latent image may then be developed to form a visible image by depositing finely divided electroscopic toner particles on the surface of the photoconductive member. The resulting visible toner image can be transferred to a suitable receiving member such as paper. This imaging process may be repeated many times with reusable photoconductive imaging members.

A flexible photoreceptor belt, one type of photoconductive imaging member, is typically multi-layered and has a substrate, a conductive layer, an optional hole blocking layer, an optional adhesive layer, a charge generating layer, a charge transport layer, and, in some embodiments, an anti-curl backing layer. High speed electrophotographic copiers and printers use flexible photoreceptor belts to produce high quality toner images. During extended cycling of the belts, a level of reduced life is encountered, which requires belt replacement in order to continue producing high quality toner images. As a result, photoreceptor characteristics that affect the image quality of toner output images as well as photoreceptor end of life, have been identified.

Photoreceptor characteristics that affect image quality and ultimately determine photoreceptor end of life include: charge acceptance when contacted with a given charge, dark decay in rested (first cycle) and fatigued state (steady state), the discharge or photo induced discharge characteristics (PIDC) which is the relationship between the potential remaining as a function of light intensity, the spectral response characteristics and the residual potential. As photoreceptors age, they undergo conditions known as cycle-up and cycle-down. Cycle-up (residual rise) is a phenomenon in which residual potential and/or background potential keeps increasing as a function of cycles, which generally leads to increased and unacceptable background density in copies of documents. Cycle-down is a phenomenon in which the dark development potential (potential corresponding to unexposed regions of the photoreceptor) keeps decreasing as a result of dark decay as a function of cycles, which generally leads to reduced image densities in the copies of documents.

Copiers and printers with cycling photoreceptor belts utilize many different methods of measuring photoreceptor characteristics. U.S. Pat. No. 3,898,001 to Hardenbrook et al. discloses a system of non-contact measurement of electrostatic change. U.S. patent application Ser. No. 07/636,045, filed on Dec. 28, 1990, entitled "Motionless Scanner", assigned to the same assignee as the present invention, describes a process for ascertaining the electrical discharge properties of a photoreceptor. These and other methods of measuring photoreceptor properties are used to diagnose a photoreceptor's ability to produce quality output images. These methods, however, do not predict when a photoreceptor will experience diminishing properties, they generally only provide feedback as to the present condition of the various characteristics that make up a photoreceptor.

U.S. patent application Ser. No. 07/636,034, filed on Dec. 28, 1990, entitled "Photoreceptor Assessment System", assigned to the same assignee as the present invention, describes a process for ascertaining the projected imaging life of a photoreceptor independent of machine (copier or printer) interactions. The process assesses virgin samples of photoreceptors from the output of a manufacturing line to determine the expected life of the photoreceptor to the point of failure due to unacceptable dark decay. Samples are cycled and charged at a constant voltage. Resulting dark decay after charging generally increases with cycling, but levels off at a crest value after a few cycles. The crest value and the associated number of imaging cycles are then used as a measure to evaluate the projected cycling life of the virgin sample.

Different copier and printer machines using varying sized photoreceptors that have been made from identical materials exhibit different life spans. Belts from different production runs have different life spans as well. As a result, a feedback control system constantly adjusts machine operating parameters to compensate for variations in photoreceptor electrical properties. When operating parameter adjustments to the machine can no longer compensate for degrading photoreceptor properties, the photoreceptor is typically replaced. In order to avoid unnecessary machine down-time due to a photoreceptor hard failure (when the machine is no longer able to compensate for degraded photoreceptor properties), photoreceptors are typically replaced when a plurality of soft faults warn the user of an impending hard failure. Soft faults typically are exceeded threshold values for photoreceptor properties that approach hard failure values.

U.S. Pat. No. 5,016,050 to Roehrs et al. discloses a control system that measures the dark decay of a photoreceptor belt to set a bias voltage on a shield of a dicorotron. As the belt ages, dark decay starts to increase and the bias on the shield increases to compensate for increasing dark decay. When the value of the bias on the shield of the dicorotron reaches a predetermined maximum level, the operator is warned by a photoreceptor near end of life message displayed on the user interface of the machine. Replacement of photoreceptors as a result of fault warnings in general tends to be premature. Unnecessarily shortening photoreceptor lives invariably increases the cost of machine maintenance. Predictive methods using soft faults generally are a function of a threshold value which is set from a population of machines. It is therefore desirable to predict the end of life of a photoreceptor more accurately in order to avoid unnecessary maintenance costs due to premature photoreceptor replacement.

SUMMARY OF THE INVENTION

In accordance with one aspect of the present invention, there is provided an improved method for predicting the end of life of an electrophotographic imaging member from a population of imaging members. The method includes the steps of recording sampled properties of the electrophotographic imaging member at a discrete time interval, determining a relationship between the recorded sampled properties and a function corresponding to the population of imaging members, and predicting the end of life of the electrophotographic imaging member in response to the determined relationship.

In accordance with another aspect of the invention, there is provided an electrophotographic printing machine of the type also having an imaging member selected from a population of imaging members. The printing machine includes means for recording sampled properties of the electrophotographic imaging member at a discrete time interval. Means, associated with the recording means, determine a relationship between the recorded samples and a function corresponding to the population of imaging members. Means, associated with the determining means, are provided for predicting the end of life of the electrophotographic imaging member from the determined relationship.

BRIEF DESCRIPTION OF THE DRAWINGS

Other aspects of the invention will become apparent as the following description proceeds and upon reference to the drawings, in which.

DESCRIPTION OF EMBODIMENT

Figure 4:
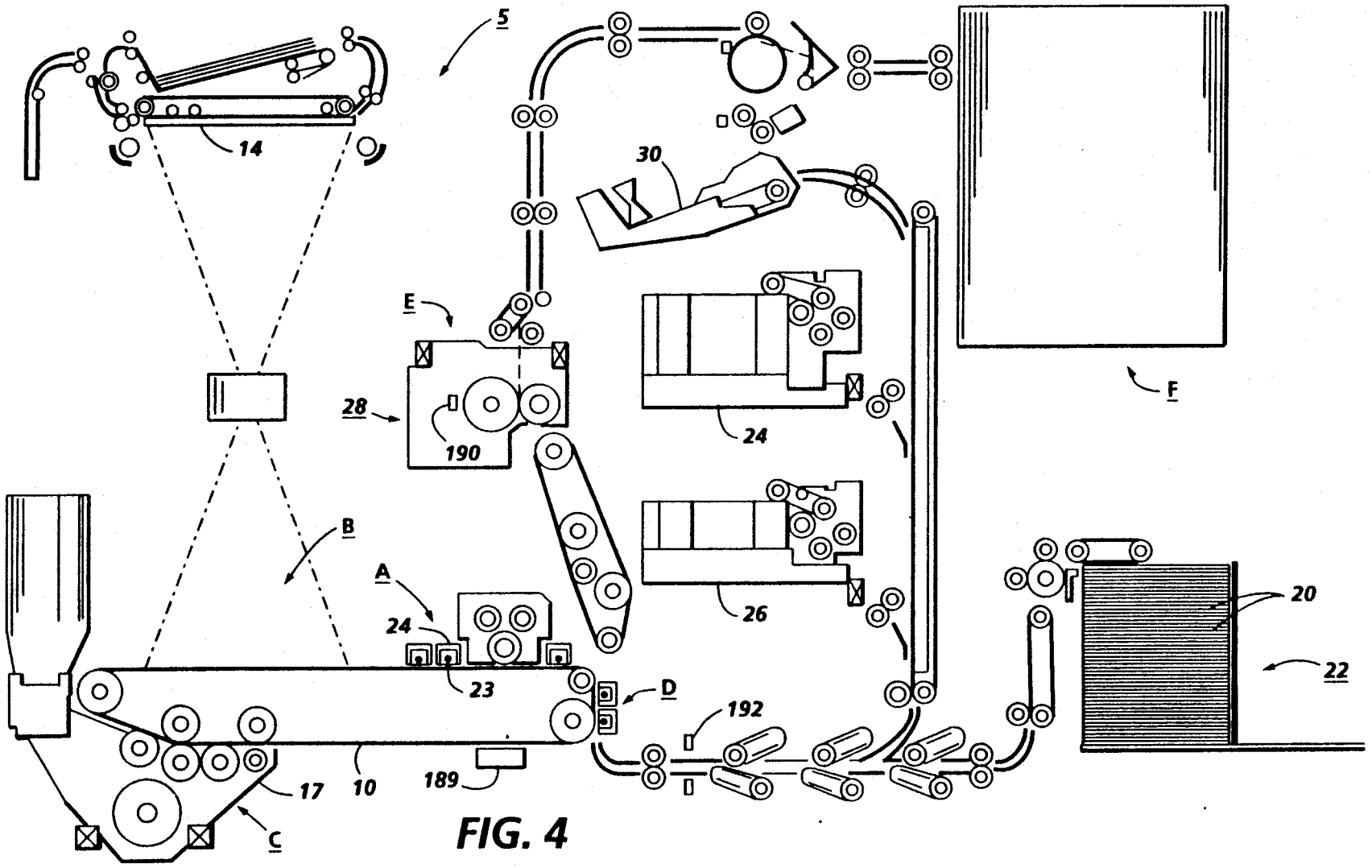
FIG. 4 is a schematic view depicting various operating components and sub-systems of a typical electrophotographic machine incorporating the present invention.
Figure 5:
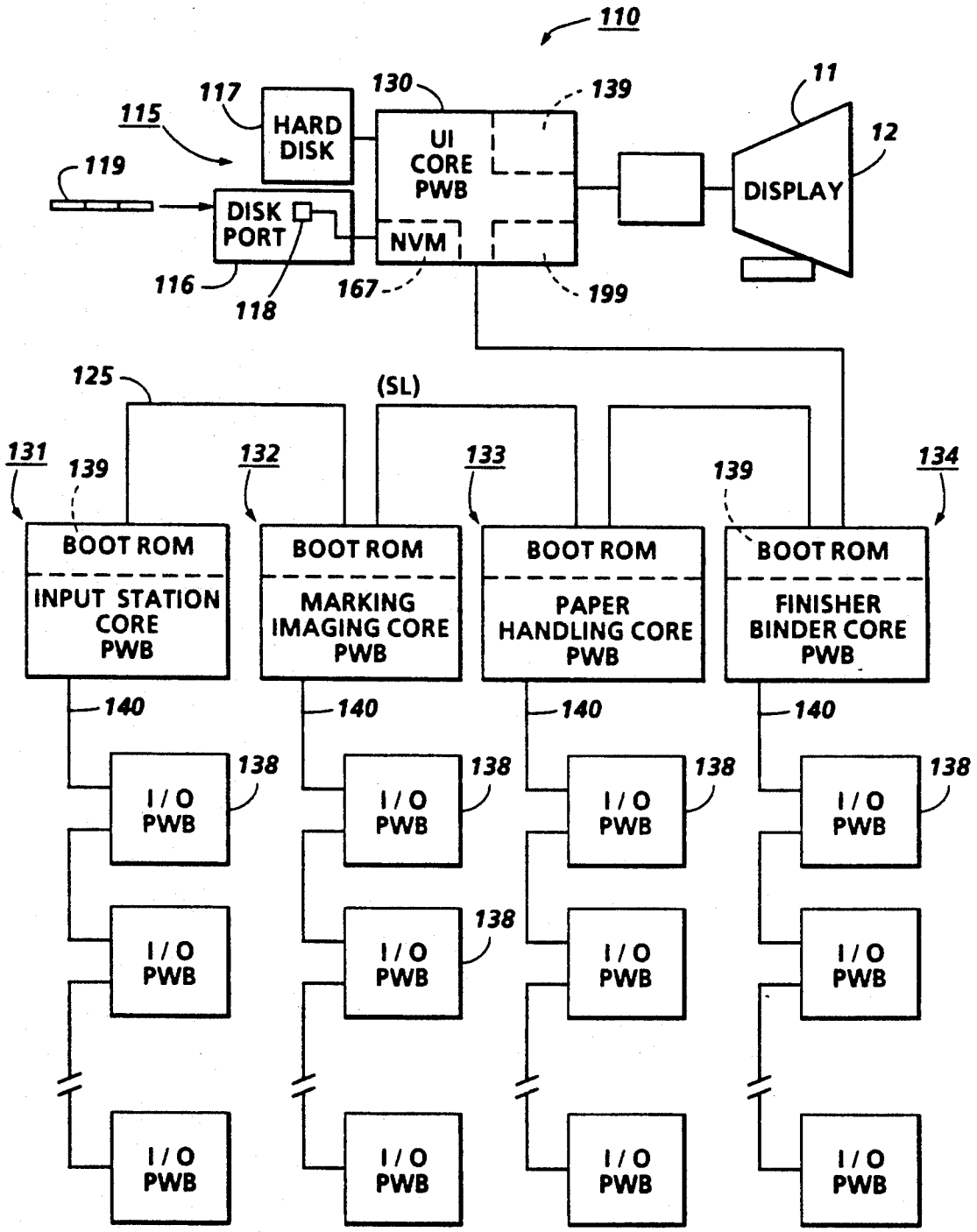
FIG. 5 is is a block diagram depicting the machine Operating System Printed Wiring Boards and shared line connections for the machine described in FIG. 4.

For a general understanding of features of the present invention, references are made to the drawings. With reference now to FIGS. 4 and 5 where the showings are for the purpose of describing an embodiment and not limiting same, there is shown an electrophotographic reproduction machine 5 composed of a plurality of programmable components and sub-systems 131 through 134 which cooperate to carry out the printing of a job programmed through touch dialog screen 12 of user interface (UI) 11.

Figure 1:
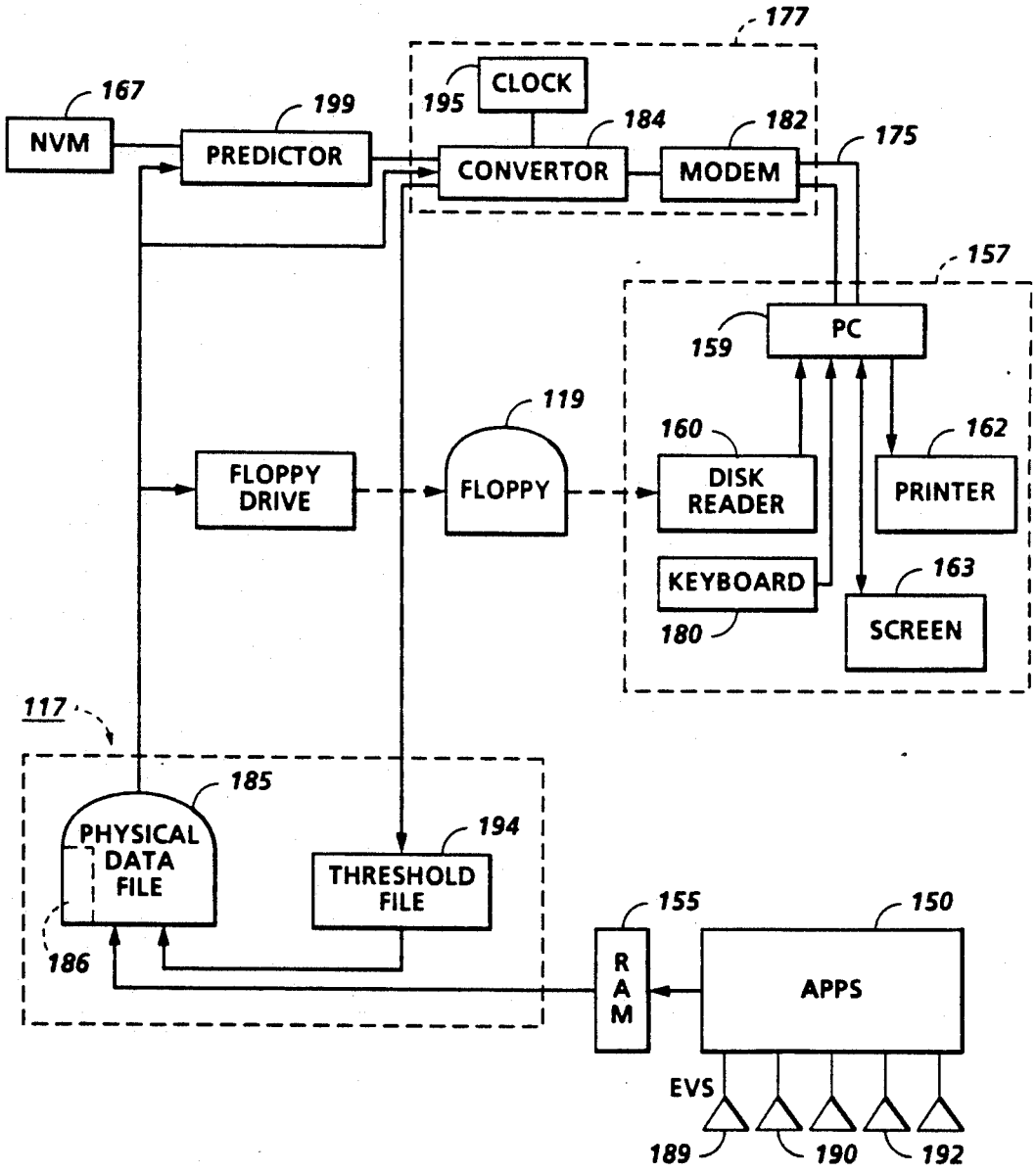
FIG. 1 is a block diagram depicting the remote communications for the machine described in FIG. 4, which includes, in accordance with the present invention, the predictor.

Machine 5 has a photoreceptor in the form of a movable photoconductive belt 10 which is charged at charging station A, as shown in FIG. 1. Next, the charged photoconductive belt is advanced through imaging station B where light rays reflected from a document being copied on platen 14 create an electrostatic latent image on photoconductive belt 10. The electrostatic latent image is developed at development station C by magnetic brush developer unit 17. The developed image is then transferred at transfer station D to a copy sheet 20 supplied from tray 22, 24 or 26. Following transfer, the copy sheet bearing the transferred image is fed to fusing station E where a fuser 28 permanently affixes the toner powder image to the copy sheet. After fusing, the copy sheets are fed to either finishing station F or to duplex tray 30 from where the sheet are fed back to transfer station D for transfer of the second toner powder image to the opposed side of the copy sheets.

Referring to FIG. 5, operation of the various components of machine 5 are regulated by an integrated control system 110 which uses operating software stored in memory 115. Memory 115 includes a main memory in the form of a rigid disk 117 on which the machine operating software is stored. The operating software includes applications software for implementing and coordinating operation of machine components. The control system includes a plurality of printed wire boards (PWBs) each having boot ROM 139, there being a UI core PWB 130, an Input Station core PWB 131, a Marking Imaging core PWB 132, a Paper Handling core PWB 133, a Finisher Binder core PWB 134 and various Input/Output (I/O) PWBs 138. A shared line (SL) 125 couples the core PWBs (130, 131, 132, 133 and 134) with each other and with memory 115 while local buses 140 serve to couple the I/O PWBs 138 with each other and their associated core PWB. Besides operating software, electrophotographic reproduction machine 5 can use a automatic xerographic set up and monitoring processes similar to the described in U.S. Pat. No. 5,016,050, the pertinent portions of which are incorporated herein by reference.

Machine 5 also employs Remote Interactive Communications (RIC) 177 to enable communication to a remote site such as service site 157, as shown in FIG. 1. Communication modem 182 serves to connect communications line 175 to the control system 110 of through converter 184 operating at a rate set by clock 195 for transmittal of machine data from control system 110 to remote site 157. Furthermore, a computer such as a PC 159, a disk reader 160, a display screen 163 and a keyboard 180 are provided at remote site 157 for use in communication with control system 110 through modem 182, as described in U.S. Pat. No. 5,057,866, the pertinent portions of which are incorporated herein by reference. Service site 157 also has printer 162 to enable printing of machine data transmitted from control system 110. Most significantly RIC 177 enables duplex communication from a machine to a remote site and from a remote site to a machine. This form of duplex communication provides a way for a remote site to alter machine operating parameters, as well as a way for the machine to request servicing in response to deteriorating operating conditions. Alternatively, machine data can be retrieved and transmitted from control system 110 to service site 157 using floppy disk 119 through port 116 having read/write head 118.

Certain machine operating parameters such as photoreceptor belt charge levels, fuser temperatures, paper feed timing etc. are permanently stored in NUM 167. These parameters represent optimum settings in order that the machine experiences the best possible machine performance. Typically, these operating parameters provide an operating range or window. Suitable sensors such as an Electrostatic Voltmeter (ESV) 189, as shown in FIG. 4, For sensing photoreceptor charge levels, temperature sensor 190 for sensing fuser roll temperatures, etc. monitor actual machine operating conditions. At discrete times during the operating cycles of machine 5, sensors such as ESV 189, temperature sensor 190, jam detectors 192, etc. are read and the data obtained and input to the machine's physical data file 185 through RAM type memory 155 using applications system software 150.

In accordance with the invention, sampled operating information 186 pertaining specifically to photoreceptor 10 is stored in physical data file 185. When photoreceptor belt 10 is either new or replaced, information 186 is reset. Control system 110 of machine 5 measures the electrical properties of photoreceptor belt 10, and records the relevant information along with the associated number of electrical belt cycles experienced at the time a measurement is taken over the life of photoreceptor belt 10. For example, the electrical photoreceptor property dark decay is measured and recorded by control system 110. Using ESV 189, control system 110 measures the effective dark decay of photoreceptor belt 10 after charging it with dicorotron 24 to a reference voltage. In order to keep the number of variables to a minimum during a measurement, bias voltage on shield 23 of corona generator 24 is held constant during these measurements. In effect, control system 110 measures and records photoreceptor belt properties at a discrete time interval such as power up, or at another predetermined interval.

Also recorded in physical data file 185 is an ascertained function which represents the properties of a photoreceptor from a production batch of photoreceptors, from which photoreceptor belt 10 operating in machine 5 was developed. The ascertained function is derived from a population of photoreceptor belts in the production batch. In time, however, the function may need modification, be it for a new type of photoreceptor being used that exhibits new properties or for an improved function more representative of the properties for currently operating photoreceptors. By use of keyboard 180 at the remote site 157, a new or altered function can be added to physical data file 185 from PC 159, via modem 182 and telephone line 175. Besides modifying the function from a remote site, a service representative could directly modify the function through dialog screen 12 on machine 5.

Given an ascertained function which is representative of a production batch of photoreceptors operating in machine 5 and enough sampled information (e.g. at least six measurements), predictor 199 fits the information to the ascertained function. Once the parameters of the function have been determined through regression analysis, a prediction is made as to when the photoreceptor will fail within some confidence level. This information can be processed in the form of a request of the remote site 157 for a new photoreceptor, or alternatively the information could be used to alter threshold file 194 on rigid disk 117 that stores critical machine operating threshold levels for the machine operation components such as the photoreceptor belt charge levels.

Figure 2:
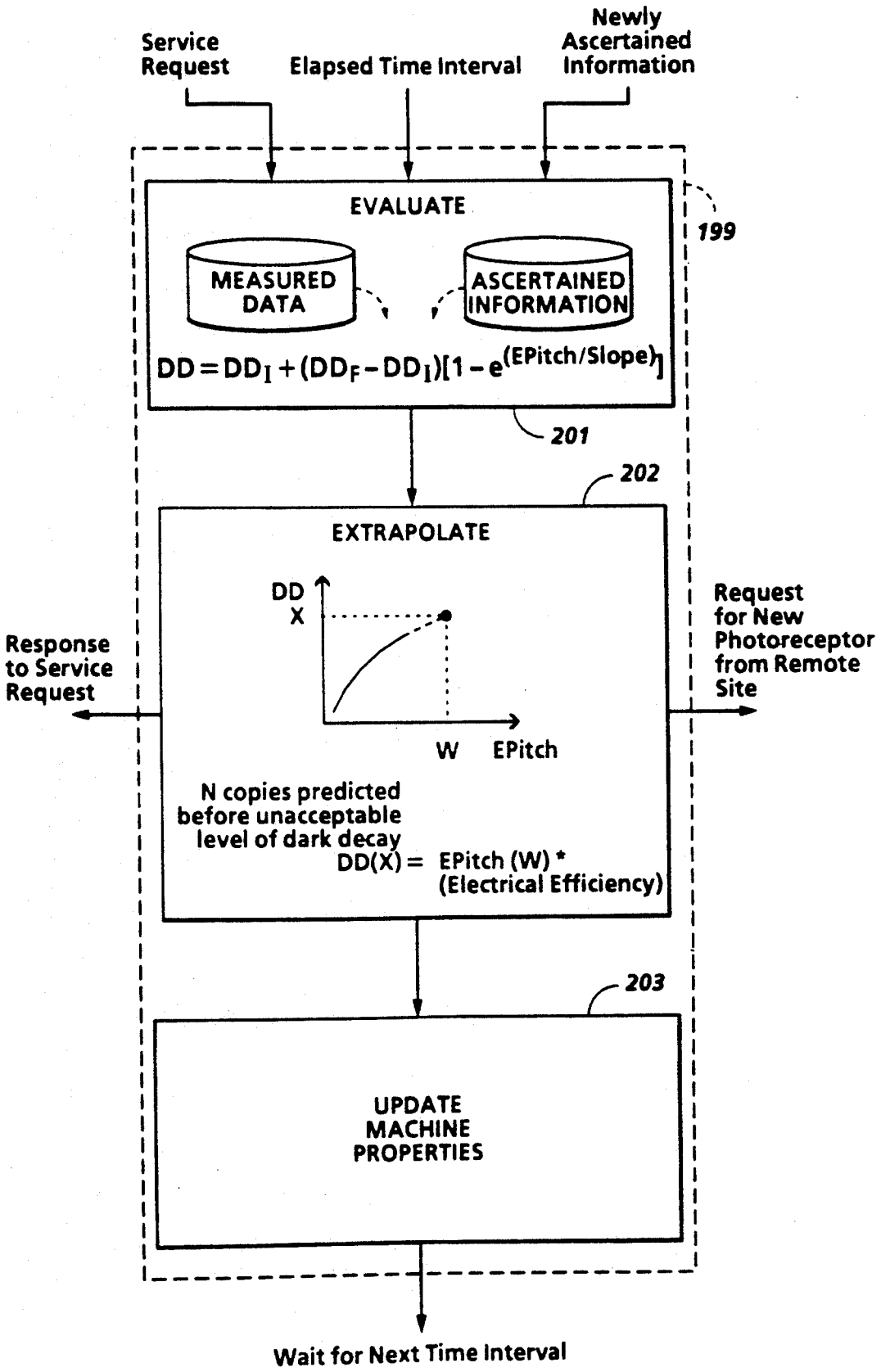
FIG. 2 is a detailed block diagram of the predictor.

A detailed view of predictor 199 is shown in FIG. 2. Predictor 199 performs the steps of evaluating, extrapolating and updating. On occasion, however, predictor 199 may only perform the steps of evaluating and extrapolating. Request for a prediction can originate from three different sources: a request from a remote service site; a request from a service representative through dialogue screen 12; or a notification in the form of a request from a discrete interval timer.

Evaluation step 201 fits sampled operating information 186 stored in physical data file 185 to an ascertained function from properties of a population of photoreceptor belts also stored in physical data file 185. For example, dark decay recorded for a population of photoreceptors at a predetermined interval of electrical cycles from a production batch of photoreceptors belts fits the following ascertained exponential function:

$$DD = DD_I + (DD_F - DD_I)(1 - e^{-(EPitch/Slope)}), \quad [1]$$

where,

DD = dark decay between bias voltage and ESV;

$DD_I$ = initial dark decay;

$DD_F$ = final dark decay;

EPitch = number of electrical cycles and

Slope = slope of the function (time constant within 63% of equilibrium value).

The parameters $DD_I$, $DD_F$ and Slope of the ascertained function are determined for sampled operating information 186 stored in physical data file 185 of photoreceptor 10 running in machine 5, using a suitable regression technique. An example of such a technique can be obtained from Dixon, W. J., BMDP Statistical Software Manual, Vol. 2, Berkeley: University of California Press, 1990, the pertinent portions of which are herein incorporated by reference. The regressed parameters, together with regression confidence limits, are then used to predict when belt 10 will fail given the characteristics of photoreceptor properties, such as dark decay.

Extrapolation step 202 uses a measure of belt life, such as electrical cycles, extrapolated from a regressed function given by step 201 together with other known criteria, such as the measured electrical efficiency of the photoreceptor belt, to predict within a period of time when, from the last measurement of the measured electrical efficiency, belt 10 will fail. The period of time used to predict when belt 10 will fail is specified in days or copies based on the particular use a machine is experiencing or the particular environment the machine is operating in. For example, the predicted point in time belt 10 will fail is given by the measured electrical efficiency of belt 10 in machine 5 and the number of electrical pitches ($EPitch_{failure}$) extrapolated from regressed ascertained function [1] using a predicted point at which belt 10 would experience an unacceptable level of dark decay ($DD_{replace}$), as shown by the following equation:

$$\begin{aligned} N\text{ copies} &= EPitch_{failure} * \text{Electrical Efficiency} \\ &= -\text{Slope}\ \ln[(DD_F - DD_{replace})/(DD_F - DD_1)] \\ &* \\ &\text{Electrical Efficiency} \end{aligned} \quad [2]$$

where

Electrical Efficiency = number of copies made divided by the number of electrical pitches;

$EPitch_{failure}$ = number of electrical cycles extrapolated from regressed ascertained function [1] using a predicted point ($DD_{replace}$) at which a belt experiences an unacceptable level of dark decay; and N copies = predicted number of copies before dark decay reaches an unacceptable level.

Figure 3:
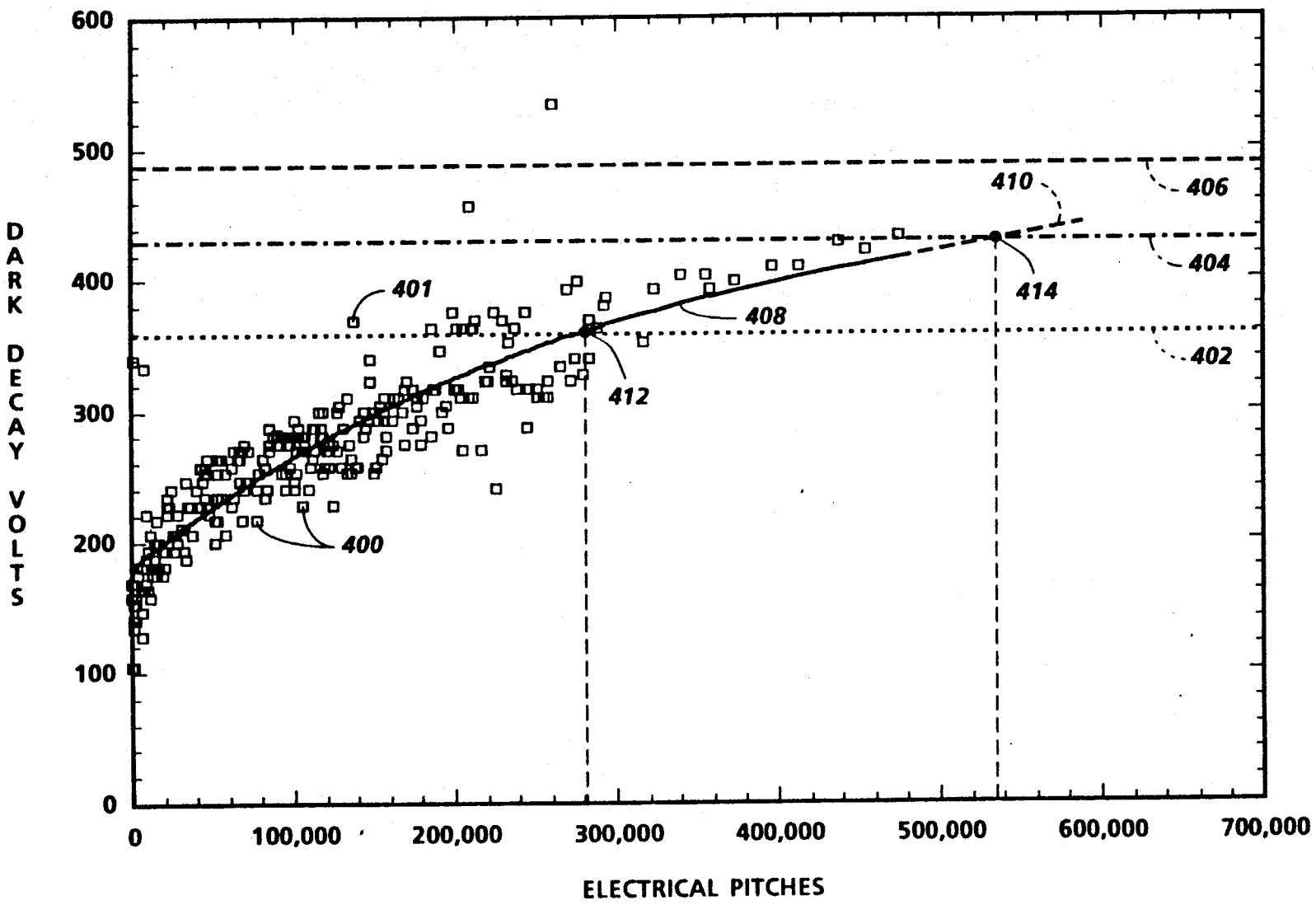
FIG. 3 is a graphic example of the present invention.

To further illustrate predictor 199, a graph of dark decay recorded for an aging photoreceptor belt 10 in machine 5 is plotted in FIG. 3. The graph showing recorded dark decay voltages for photoreceptor belt 10, is plotted versus the number of elapsed electrical pitches photoreceptor 10 has experienced. Each square 400 represents the stored dark decay sampled at a specified electrical pitch interval. Horizontal line 402 is typically the dark decay voltage over which soft faults are recorded by the control system 110 of machine 5. Soft faults are indications that a photoreceptor belt may fail in the future, but does not anticipate when this event may occur. If dark decay sample 401 results in a soft fault indication to a user in the form of a message that the photoreceptor is near its end of life is an inefficient method of photoreceptor end of life notification since degraded copy quality is not experienced from the photoreceptor until dark decay voltage 404 is reached. Samples from a population of machines are used to determine when dark decay voltage 404 occurs (represented by $DD_{replace}$ in equation [2]), which is a predicted point at which inherent photoreceptor failure due to degraded image quality problems occurs. Ultimately, voltage 406 is the maximum voltage that control system 110 is able to bias the photoreceptor belt 10 in order to compensate for its degrading properties.

Curve 408 is regressed using measured dark decay samples of photoreceptor 10 to fit ascertained exponential function [1] in lieu of providing photoreceptor near end of life messages each time a dark decay soft fault warning is recorded over dark decay voltage 402. Curve 410, also shown in FIG. 3, is extrapolated in order to predict dark decay voltages 404 and 406. Note, if curve 408 was further back in time, point 402 would be extrapolated as well. Curve 408 is solid where it is regressed from dark decay recorded from photoreceptor belt 10, while curve 410 is broken (or dotted) when dark decay for belt 10 is extrapolated. Point 412 from regressed curve 408 and on horizontal line 402, and point 414 from extrapolated curve 410 and on horizontal line 404, is used to asses the significance of the multiple soft fault warnings (i.e. all recorded samples above dark voltage denoted by horizontal line 402) that are recorded. Using extrapolated curve 410 to predict point 414 at which the photoreceptor inherently fails, maximizes photoreceptor life.

The step of updating the machine properties 203, updates threshold values for critical machine operating components such as the photoreceptor belt charge levels. Run time process controls have various detectors that monitor machine operating conditions at discrete times during the operating cycle of the machine. In using extrapolated end of life photoreceptor information, operational adjustments are made to the machine process control algorithms. For example, extrapolated end of life photoreceptor information better estimates photoreceptor charge control properties such as rest recovery, dark decay and cycle-down compensation.

Because the invention more accurately determines when a photoreceptor should be replaced, numerous advantages are appreciated. For instance, the present invention prolongs the use of photoreceptors in xerographic printing machines by avoiding premature replacement as a result of less precise methods of predicting photoreceptor end of life. Also, the present invention has a further advantage of real time diagnostics feedback, which can be directed to a technician in real time or automatically relayed to a service center at a remote site as a request for a new photoreceptor belt. This improved method of photoreceptor diagnostic feedback diminishes the amount of time printing machines are unexpectedly down due to photoreceptor failure. Besides improving photoreceptor diagnostics, regressed photoreceptor information is also used to improve machine charge control algorithms in order to better estimate photoreceptor properties such as rest recovery, dark decay and cycle down compensation. In effect, run time process controls are more effective as a result of additional and more accurate information predicting photoreceptor end of life.

In summary, the present invention is an improved method and apparatus for predicting the point at which photoreceptors fail. In order to make an accurate prediction, the invention takes into account global photoreceptor information about a population of photoreceptors as well as information directed to a specific photoreceptor operating under particular environmental conditions. This information is used not only to predict photoreceptor end of life, but to make adjustments in the printing machine in order to correct deteriorating performance. The invention can be used as an embedded end of life predictions system to notify a remote service site of photoreceptor problems in the printing machine in such a manner that it is transparent to a user of the printing machine. Alternatively, the invention provides real time feedback to a technician when requesting the condition of a photoreceptor.

It is therefore apparent that there has been provided, in accordance with the present invention, an improved method and apparatus for predicting the end of life of a photoreceptor that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method for predicting the end of life of an electrophotographic imaging member from a population of imaging members comprising the steps of:

a) recording samples at a discrete time interval for a property of the electrophotographic imaging member;

b) determining a relationship between the recorded samples and a function corresponding to the population of imaging members; and c) predicting the end of life of the electrophotographic imaging member in response to said determining step.

2. The method of claim 1, further comprising the step of communicating the predicted end of life of the imaging member to a user interface of a printing machine.

3. The method of claim 1, further comprising the step of communicating interactively with a remote site, said step of communicating including transmitting the predicted end of life of the imaging member to the remote site.

4. The method according to claim 1, further comprising the step of updating properties of a printing machine in response to the predicted end of life of the imaging member.

5. The method according to claim 1, wherein said step of recording samples comprises setting the discrete time interval to a number of electrical cycles of the electrophotographic imaging member.

6. The method according to claim 1, wherein said step of recording comprises the steps of:

sampling an electrical property of the imaging member at the discrete time interval; and storing the sampled electrical property and the discrete time interval in a physical data file.

7. The method according to claim 6, wherein said sampling step comprises sampling the electrical property selected from the group consisting of dark decay, residual rise and charge current.

8. The method according to claim 1, wherein said step of determining a relationship comprises developing a curve representative of the recorded samples.

9. The method according to claim 8, wherein said step of developing a curve comprises performing a regression of the recorded samples with respect to the function corresponding to the population of imaging members.

10. The method according to claim 9, wherein said performing step comprises characterizing a function corresponding to the population of imaging members using the following equation:

$$DD = DD_I + (DD_F - DD_I)(1 - e^{-(EPitch/Slope)}),$$

where,

DD = dark decay between bias voltage and ESV;

$DD_I$ = initial dark decay;

$DD_F$ = final dark decay;

EPitch = number of electrical cycles; and

Slope = slope of the curve.

11. The method according to claim 1, wherein said step of predicting the end of life of the imaging member comprises extrapolating the end of life of the imaging member in response to said determining step.

12. An electrophotographic printing machine of the type having an imaging member selected from a population of imaging members, comprising:

a) means for recording samples at a discrete time interval for a property of the imaging member;

b) means, associated with said recording means, for determining a relationship between the recorded samples and a function corresponding to the population of imaging members; and c) means, associated with said determining means, for predicting the end of life of the electrophotographic imaging member from the determined relationship.

13. The printing machine according to claim 12, further comprising:

a receiving station; and means, associated with said predicting means, for transmitting the predicted end of life of the electrophotographic imaging member to said receiving station.

14. The printing machine according to claim 13 wherein said receiving station comprises a receiving station located remotely from the printing machine.

15. The printing machine according to claim 13 wherein said receiving station comprises a user interface integral with the printing machine.

16. The printing machine according to claim 13, wherein said transmitting means comprises a remote interactive communications system.

17. The printing machine according to claim 12 of the type having an operating component, further comprising means for updating the operating component in response to said predicting means.

18. The printing machine according to claim 12, wherein said recording means comprises: a corona generator for changing at the discrete time interval the imaging member; and an electrostatic voltmeter to sample the electrical properties of the charged imaging member such as dark decay; and a physical data file for storing the sample and the time interval.

19. The printing machine according to claim 12, wherein said recording means comprises a physical data file which stores the sampled properties in the form of electrical signals.

20. The printing machine according to claim 12, wherein said determining means comprises means for developing a curve through regression analysis using the recorded samples and a function corresponding to the population of imaging members characterized by the following equation:

$$DD = DD_I + (DD_F - DD_I)(1 - e^{-(EPitch/Slope)}),$$

where,

DD = dark decay between bias voltage and ESV;

$DD_I$ = initial dark decay;

$DD_F$ = final dark decay;

EPitch = number of electrical cycles; and

Slope = slope of the curve.

21. The printing machine according to claim 12 wherein said predicting means comprises means for extrapolating the end of life of the imaging member from the determined relationship.

* * * * *